US005826141A

United States Patent [19]

Mitsuya

[11] Patent Number: 5,826,141

[45] Date of Patent: Oct. 20, 1998

[54] FIXING DEVICE IN AN IMAGE-FORMING MACHINE

[75] Inventor: Toshiyuki Mitsuya, Osaka, Japan

[73] Assignee: Mita Industrial Company, Ltd., Osaka, Japan

[21] Appl. No.: 890,346

[22] Filed: Jul. 9, 1997

[30] Foreign Application Priority Data

Jul. 9, 1996 [JP] Japan ..... 8-199655

[51] Int. Cl.[6] ..... G03G 15/20

[52] U.S. Cl. ..... 399/122; 399/320; 399/328; 399/330

[58] Field of Search ..... 399/122, 330, 399/320, 331, 328

[56] References Cited

U.S. PATENT DOCUMENTS 4,782,359 11/1988 Tomoe ..... 399/122

*Primary Examiner*—Arthur T. Grimley
*Assistant Examiner*—Hoan Tran
*Attorney, Agent, or Firm*—Antonelli, Terry, Stout & Kraus, LLP

[57] ABSTRACT

A fixing device in an image-forming machine comprising a lower housing, an upper housing supported on one side of said lower housing and allowed to rotate between a closed position and an open position, a pressing roller rotatably mounted on said lower housing, and a heating roller having bearing members attached to both ends thereof and is detachably mounted on said upper housing, said upper housing being provided with nearly semicircular recessed mounting portions with which will be fitted said bearing members of said heating rollers. The upper housing is equipped with a holder member which is so constituted as to move to a first position where the said bearing members are allowed to be attached to, or detached from, said recessed mounting portions, and to a second position where it comes into contact with said bearing members fitted to said recessed mounting portions to maintain said bearing members fitted to said recessed mounting portions, and a fastening means is provided to fasten said holding member at said second position.

2 Claims, 7 Drawing Sheets

FIXING DEVICE IN AN IMAGE-FORMING MACHINE

FIELD OF THE INVENTION

The present invention relates to a fixing device mounted in an image-forming machine such as electrostatic copier, facsimile, laser printer, etc. and works to heat-fix a toner image transferred onto a paper.

DESCRIPTION OF THE PRIOR ART

An image-forming machine is equipped with a fixing device for heat-fixing a toner image that has been transferred onto a suitable paper. The fixing device of this type is provided with a pair of fixing rollers consisting of a heating roller and a pressing roller. The heating roller is constituted by placing a heater in a roller body made of an aluminum alloy coated on its peripheral surfaces with a fluorine-containing resin or the like. The pressing roller is constituted by fitting a cylindrical roller unit formed of a silicone rubber or the like onto the roller body made of an aluminum alloy. The thus constituted heating roller and pressing rollers are consumables subject to be worn out, and are, hence, renewed after they have been used for a predetermined period of time. Therefore, the fixing device is constructed as a unit and is detachably mounted on a predetermined position of the image-forming machine body.

In the fixing device constructed as a unit, a fixing housing for mounting a pair of fixing rollers consisting of the heating roller and the pressing roller is constituted by a lower housing and an upper housing, the upper housing being rotatably supported by the lower housing on its one side as a turning pivot so as to be opened and closed. In the thus constituted fixing housing, in general, the pressing roller is detachably mounted in the lower housing and the heating roller is detachably mounted in the upper housing. The following two mounting structures have heretofore been employed for mounting the heating roller in the upper housing that is constructed to be opened and closed relative to the lower housing.

One is a structure in which after the heating roller is set in the upper housing, bearing members such as bushes or bearings are inserted from the outer side of the upper housing, and are fastened to the upper housing in the peripheral direction by a fastening means such as screws or the like.

Another one is a structure in which, as shown in FIG. 9, bearing members 3 are fitted to both ends of the heating roller 2, semicircular recessed mounting portions 8 are formed in the side plates 7 of the upper housing 6 rotatably supported by the lower housing 4 on a support shaft 5 as a pivot, the bearing members 3 are fitted to the recessed mounting portions 8, and the outer peripheral surfaces of the bearing members 3 that are not fitted to the recessed mounting portions 8 are supported by leaf springs 9 attached to the upper housing 6.

According to the above-mentioned former structure for mounting the heating roller, troublesomeness is involved in the operation for inserting the bearing members for the heating roller that is set beforehand to the upper housing. For removing the heating roller, furthermore, the bearing members must be first removed, and removal of the bearing members requires cumbersome operation for the attachment and detachment.

On the other hand, according to the latter structure for mounting the heating roller shown in FIG. 9, when the bearing members 3 attached to both ends of the heating roller 2 are to be fitted to the semicircular recessed mounting portions 8 formed in the side plates 7 of the upper housing 6, the leaf spring 9 must be displaced against the resilient force up to a position indicated by a two-dotted chain line in FIG. 9 so that it will not serve as an obstacle. Therefore, the operation for fitting the bearing members to the recessed mounting portions 8 is very cumbersome. And, when the heating roller 2 mounted on the upper housing 6 is to be removed, the leaf spring 9 must be again displaced against the resilient force up to the position indicated by a two-dotted chain line in FIG. 9, which involves the same problem as that at the time of mounting the heating roller 2.

In the case where the operation for attaching or detaching the heating roller involves difficulty as experienced in the above-mentioned structures for mounting the heating roller, trouble may occur such as causing the peripheral surfaces of the heating roller to be casually demaged during the attaching or detaching operation. In the latter structure for mounting the heating roller shown in FIG. 9, in particular, difficulty is involved in designing the structure so that the leaf spring 9 will not serve as an obstacle at the time of attaching or detaching the heating roller 2. Besides, as the resilient force decreases due to aging of the leaf spring 9, the function for supporting the heating roller 2 decreases, which results in the occurrence of play. A conspicuous play could become a cause of damaging the heater mounted in the heating roller 2.

SUMMARY OF THE INVENTION

It is an object of the present invention to provide a fixing device in an image-forming machine, which enables the fixing rollers to be easily attached to, or detached from, the fixing housing, and is capable of stably holding the fixing rollers.

In order to accomplish the above-mentioned object according to the present invention, there is provided a fixing device in an image-forming machine comprising a lower housing, an upper housing that is supported on one side of said lower housing and is allowed to rotate between a closed position and an open position, a pressing roller rotatably mounted on said lower housing, and a heating roller that has bearing members attached to both ends thereof and is detachably mounted on said upper housing, said upper housing being provided with nearly semicircular recessed mounting portions of which the lower portions are opened so that said bearing members attached to said heating rollers can be fitted thereto, and said heating roller being allowed to be attached to, or detached from, said recessed mounting portions in a state where said upper housing is located at the open position, wherein said upper housing is equipped with a holder member which is so constituted as to move to a first position where said bearing members attached to said heating roller are allowed to be attached to, or detached from, said recessed mounting portions, and to a second position where it comes into contact with said bearing members fitted to said recessed mounting portions to maintain the fitting of said bearing members to said recessed mounting portions, and a fastening means is provided to fasten said holding member at said second position.

According to the present invention, furthermore, there is provided a fixing device in an image-forming machine, wherein said lower housing is provided with an engaging portion with which will engage part of the holder member when said holder member is brought to said first position in a state where said upper housing is brought to the open position, and the upper housing is restricted from turning to the closed position from the open position in a state where said holder member is brought to said first position.

DETAILED DESCRIPTION OF THE PREFERRED EMBODIMENTS

A preferred embodiment of a fixing device in an image-forming machine constituted according to the present invention will now be described in detail with reference to the accompanying drawings.

Figure 1:
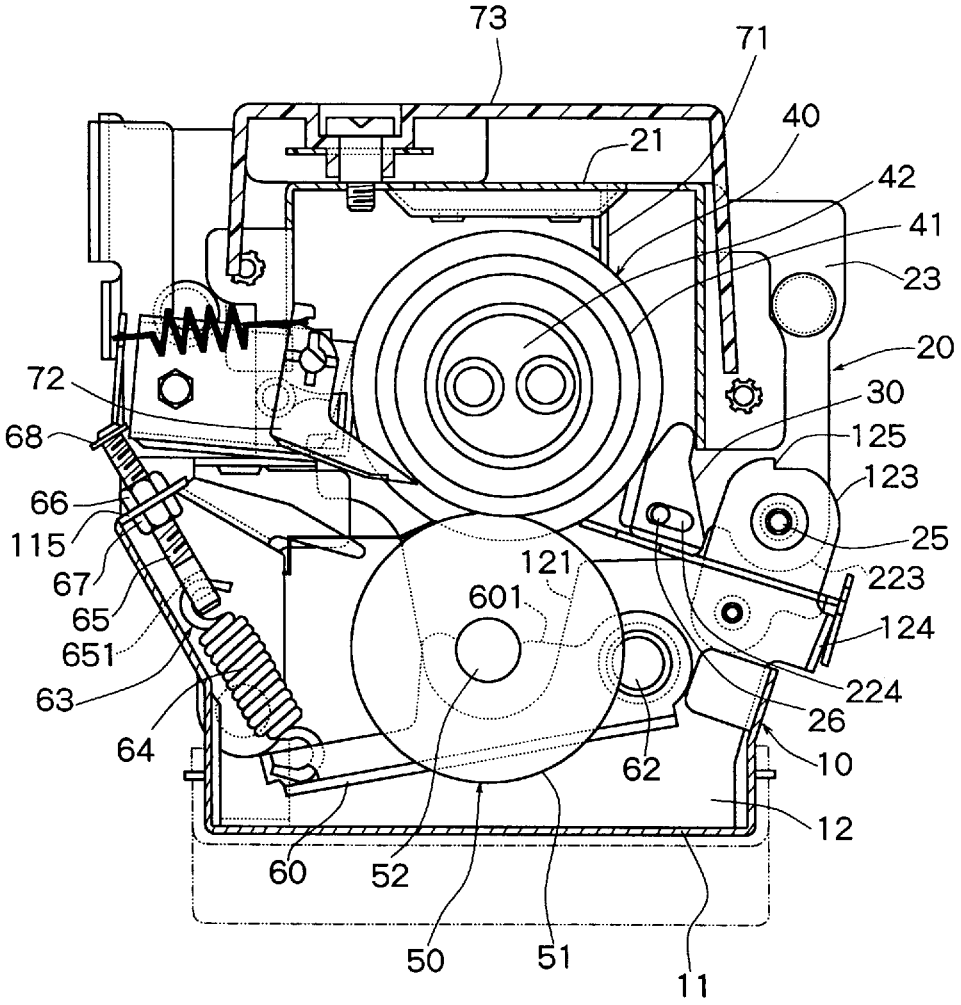
FIG. 1 is a sectional view illustrating a fixing device in an image-forming machine constituted according to an embodiment of the present invention.
Figure 2:
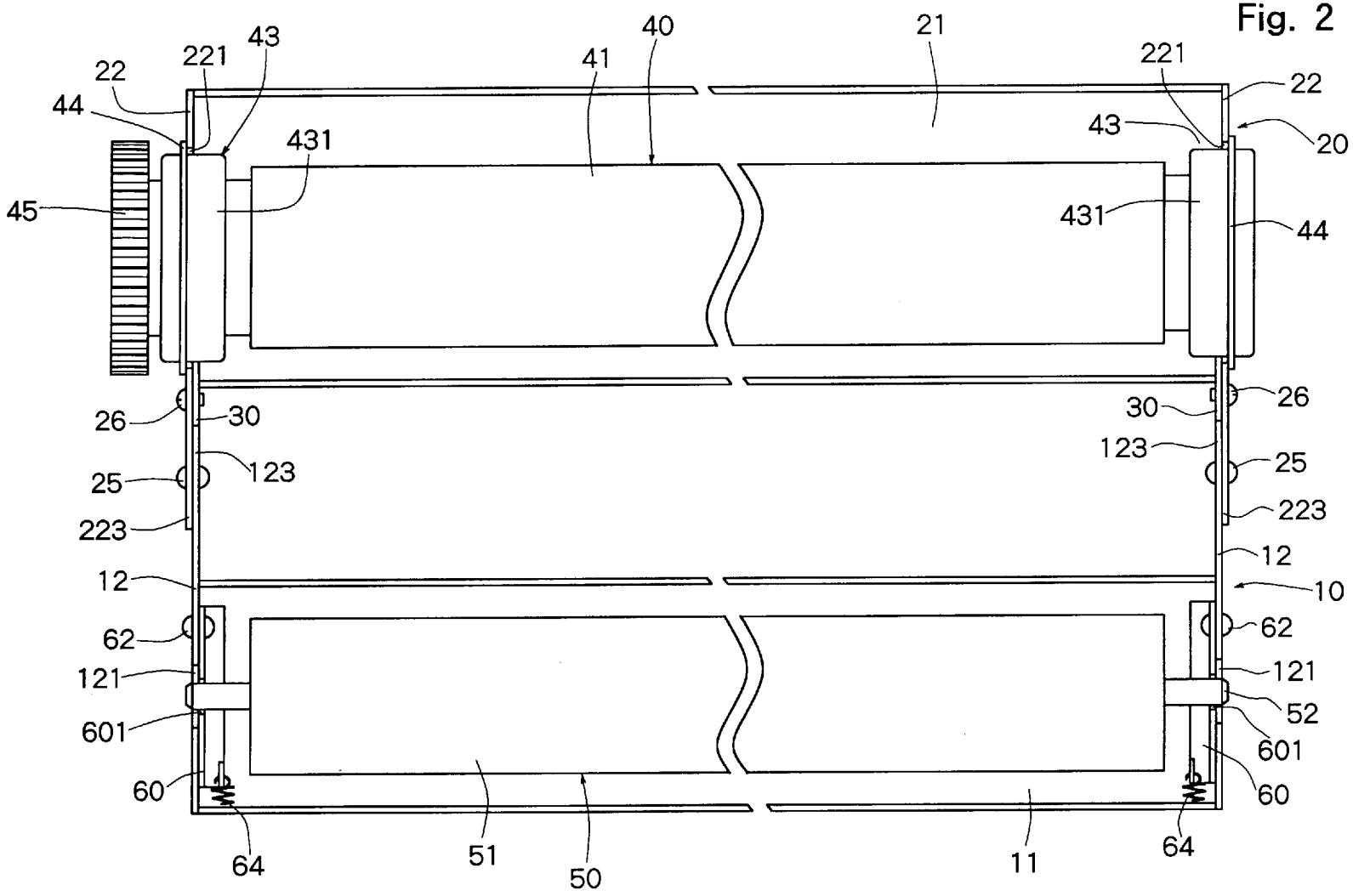
FIG. 2 is a plan view illustrating a state where an upper housing constituting the fixing device shown in FIG. 1 is brought to the open position.

FIG. 1 is a sectional view illustrating a fixing device in an image-forming machine constituted according to the present invention, and FIG. 2 is a plan view of the fixing device shown in FIG. 1.

Figure 3:
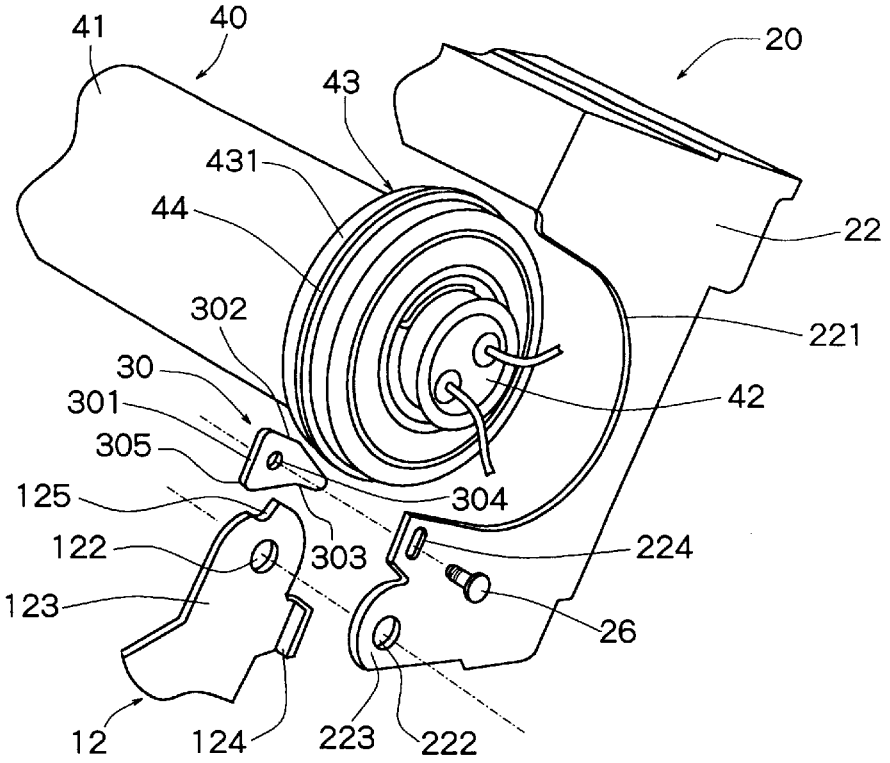
FIG. 3 is a perspective view of major portions illustrating, in a disassembled manner, parts constituting the upper housing and a heating roller in the fixing device shown in FIG. 1.

The fixing device in the image-forming machine is equipped with a fixing housing constituted by a lower housing 10 and an upper housing 20. The lower housing 10 comprises a lower case plate 11, and side plates 12, 12 attached to both ends of the lower case plate 11. Each side plate 12 has a recessed portion 121 formed in a central portion with its upper end being opened, and a support portion 123 having a shaft hole 122 at an upper end on one side of the side plate 12 as shown in FIG. 3. The upper housing 20 comprises an upper case plate 21, and side plates 22, 22 attached to both ends of the upper case plate 21. Each side plate 22 has a semicircular recessed mounting portion 221 formed in a central portion with its lower end being opened, and a support portion 223 having a shaft hole 222 at the lower end on one side of the side plate 22 as shown in FIG. 3. The support portions 223 of the thus constituted upper housing 20 are positioned on the outer sides of the support portions 123 of the lower housing 10, support shafts 25 are inserted in the shaft holes 122, 222 formed in these support portions, and the upper housing 20 is rotatably supported by the lower housing 10 to allow to turn between the closed position shown in FIGS. 1 and 4 and the open position shown in FIG. 6. In a state of being brought to the open position shown in FIG. 6, edges on one side of the side plates 22 constituting the upper housing 20 are brought into contact with stoppers 124 formed by being bended at the ends on one side of the side plates 12 constituting the lower housing 10, thereby to restrict the turn of the upper housing 20.

The lower end of the side plate 22 constituting the upper housing 20 has an elongated hole 224 formed to meet nearly at right angles with the recessed mounting portion 221. A screw 26 is inserted in the elongated hole 224 from the outer side of the side plate 22, and is screwed into a holder member 30 arranged on the inside of the side plate 22.

The holder member 30 is of a nearly triangular shape having a bottom side 301, a holder side 302 and a turn-blocking side 303, and has a threaded hole 304 formed in the central portion on the side of the bottom side 301 into which will be screwed the screw 26. Upon moving the holding member 30 along the elongated hole 224 in a state where the screw 26 is loosened, therefore, the holder member 30 can be brought to a first position (see FIG. 6) where a heating roller 40 that will be described later is permitted to be attached to, or detached from, the upper housing 20 and to a second position (see FIGS. 1 and 4) where the heating roller 40 mounted on the recessed mounting portion 221 of the upper housing 20 is held in a mounted state. When the screw 26 is tightened at the second position, the holder member 30 slightly turns, whereby a portion of the holder side 302 comes into contact with the outer peripheral surface of the bearing member 43 attached to the heating roller 40, so that the bearing member 43 attached to the heating roller 40 is held being fitted to the recessed mounting portion 221. When the holder member 30 is located at the first position (see FIG. 6), the end of the turn-blocking side 303 comes into contact with the lower edge of the upper case plate 21 that constitutes the upper housing 20, and thus, the holder member 30 restricts the turn about the screw 26. In a state where the holder member 30 is located at the first position shown in FIG. 4, an engaging portion 305 that is a vertex formed between the bottom side 301 and the turn-blocking side 303 is positioned on the lower side.

A recessed engaging portion 125 is formed at an upper end of the support portion 123 of the side plate 12 constituting the lower housing 10. In a state where the holder member 30 is brought to the first position, the engaging portion 305 engages with the recessed engaging portion 125 as shown in FIG. 6.

The heating roller 40 mounted in the upper housing 20 is constituted by a roller body 41 made of an aluminum alloy coated on its outer peripheral surfaces with a fluorine-containing resin, a heater (halogen lamp) 42 built in the roller body 41, and bearing members 43, 43 attached to both ends of the roller body 41. On the bearing members 43 are mounted positioning rings 44 protruding beyond the outer peripheral surfaces 431 thereof. An input gear 45 is attached to the outside (left end in FIG. 2) of the bearing member 43 which is on the back side of the roller body 41, and is coupled in a transmission way to a drive mechanism disposed in the image-forming machine.

Figure 6:
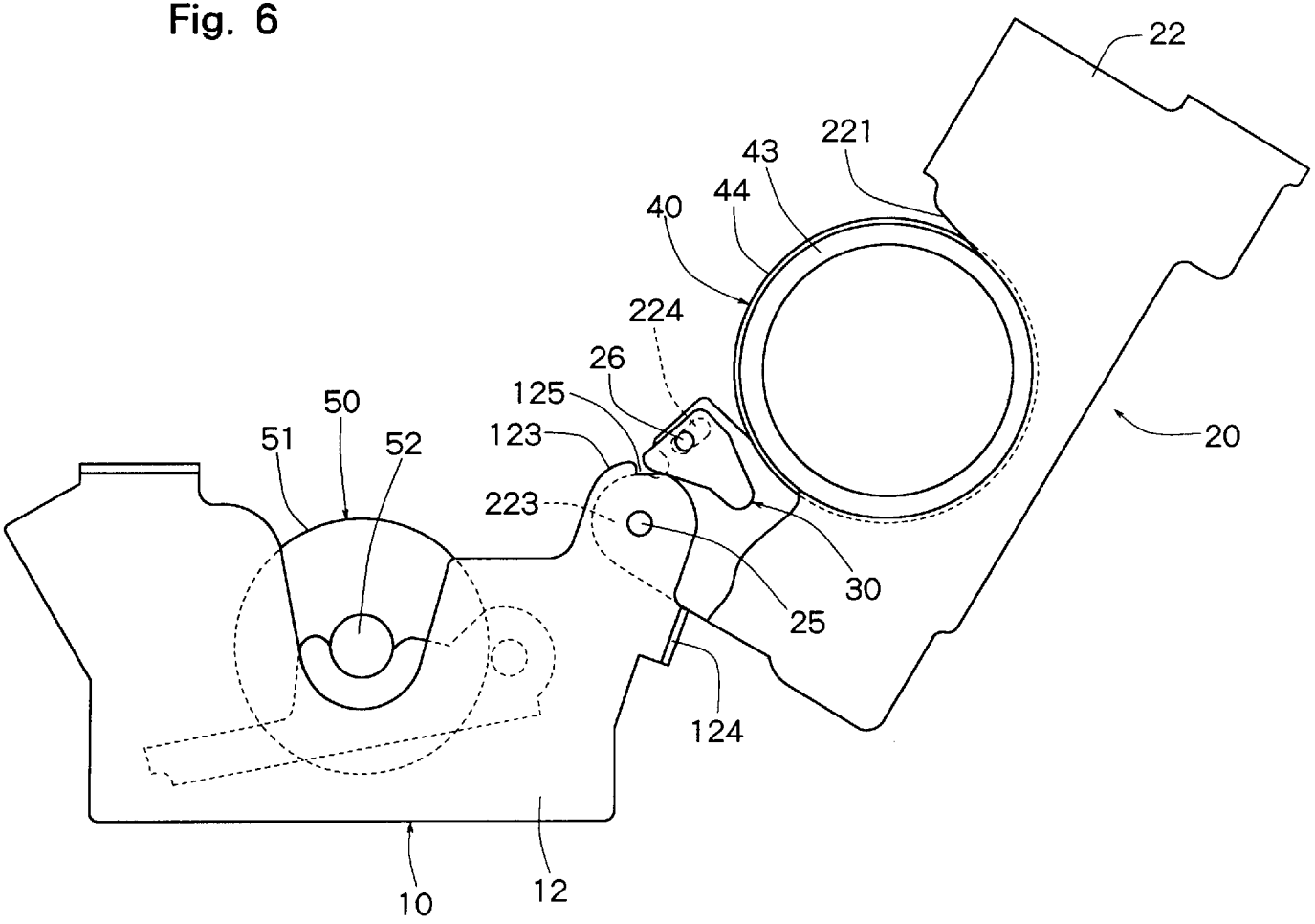
FIG. 6 is a side view illustrating, in cross section, major portions in a state when the upper housing is turned from the open position toward the closed position in a state where the heating roller mounted on the upper housing has been forgotten to be fastened by the holder plate in the fixing device shown in FIG. 1.

To mount the thus constituted heating roller 40 in the upper housing 20, the upper housing 20 is turned in the clockwise direction in FIG. 6 on a support shaft 25 as a center to be brought to the open position. At this moment, when the screw 26 screwed into the threaded hole 304 of the holder member 30 is loosened, the screw 26 and the holder member 30 fall along the elongated hole 224 due to their own weights, and are brought to the first position. Next, the bearing members 43, 43 are fitted to the recessed mounting portions 221, 221 while bringing the positioning rings 44 fitted to the bearing members 43, 43 of the heating roller 40 into contact with the outer sides of the side plates 22, 22 that constitute the upper housing 20. Thus, after the bearing members 43, 43 of the heating roller 40 are fitted to the recessed mounting portions 221, 221, a screw driver is brought into engagement with the head of the screw 26 to upwardly move the screw 26 and the holder member 30 along the elongated hole 224 until they are brought to the second position in FIGS. 1 and 4 and at this position, the screw 26 which is a fastening means is tightened, whereby the holder member 30 is slightly turned to bring part of the holder side 302 into contact with the outer peripheral surface of the bearing member 43 attached to the heating roller 34, and thus, the holder member 30 is fastened at the second position. This operation is effected for both the holder member 30 on the front side and the holder member 30 on the back side, so that the heating roller 40 is held at a predetermined position of the upper housing 20. Since in a state where the heating roller 40 is held, the holder member 30 is stably fastened by the screw 26, the bearing member 43 that is fastened does not cause play even after the passage of time. If the screw 26 is loosened, it may be restored by simply tightening it.

After the heating roller 40 is mounted on the upper housing 20, the upper housing 20 is turned in the counterclockwise direction in FIG. 6 on the support shaft 25 as a center. Here, since the holder member 30 is located at the second position, the engaging portion 305 of the holder member 30 does not engage with the recessed engaging portion 125 formed in the support member 123 of the side plate 12 of the lower housing 10, and the upper housing 20 is allowed to turn to the closed position shown in FIGS. 1 and 4.

When it is attempted to turn the upper housing 20 in the counterclockwise direction in FIG. 6 on the support shaft 25 as a center to bring it to the closed position without fastening the screw 26 to the holder member 30 at the second position after the bearing members 43, 43 of the heating roller 40 have been fitted to the recessed mounting portions 221, 221, the holder member 30 is brought to the first position (see FIG. 6) due to its own weight and the engaging portion 305 is brought into engagement with the recessed engaging portion 125. It is not therefore allowed to turn the upper housing 20 to the closed position. This makes it possible to prevent the heating roller 40 from being forgotten to be fastened by the holder member 30.

Figure 4:
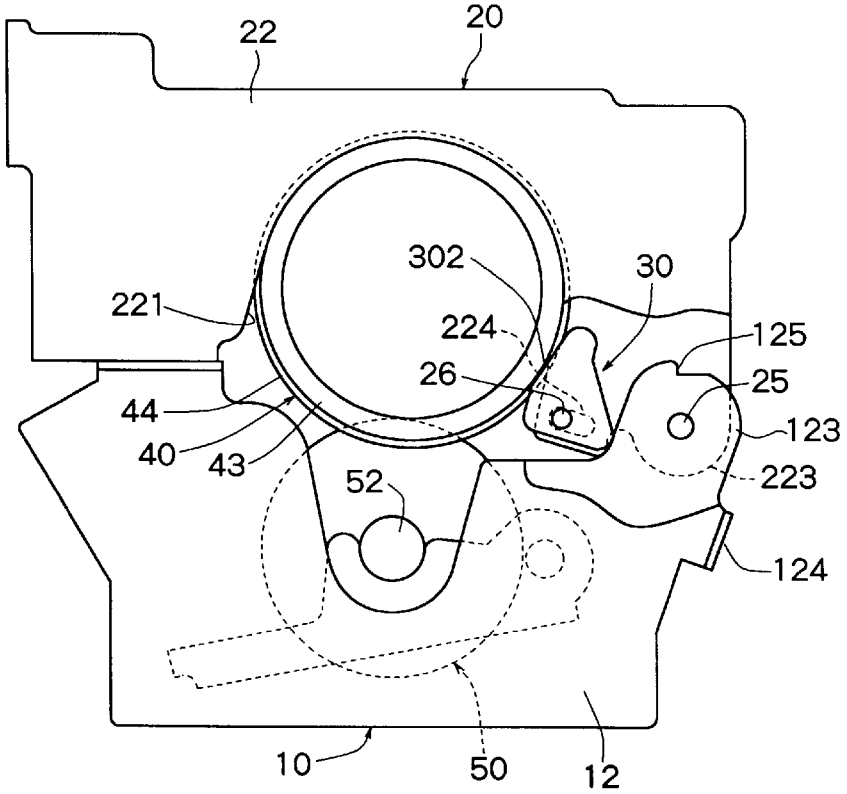
FIG. 4 is a side view illustrating, in cross section, major portions in a state where the upper housing constituting the fixing device shown in FIG. 1 is brought to the closed position.
Figure 5:
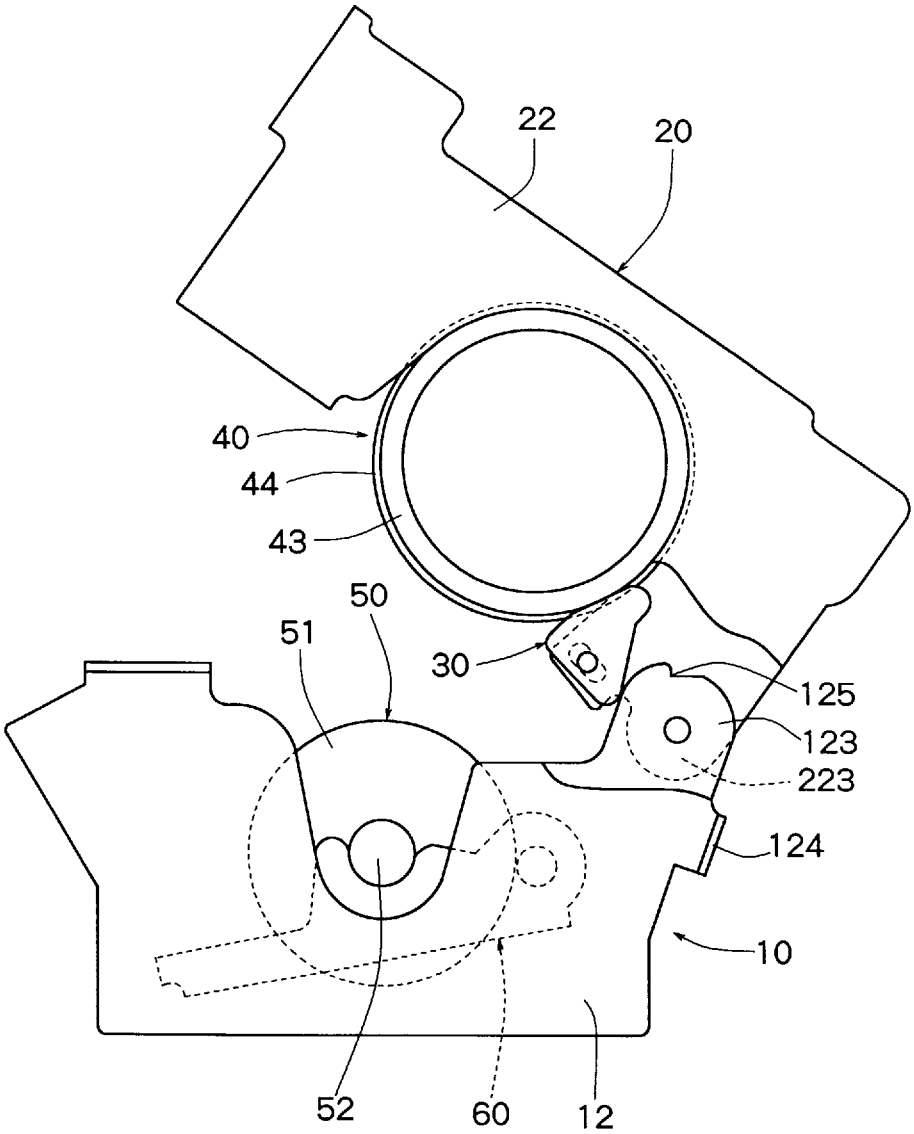
FIG. 5 is a side view illustrating, in cross section, major portions in a state where the upper housing in the fixing device of FIG. 1 is turned from the open position toward the closed position after the heating roller mounted on the upper housing is fastened by a holder plate.

To remove the heating roller 40 from the upper housing 20, the upper housing 20 is turned in the clockwise direction on the support shaft 25 as a center from the closed state shown in FIGS. 1 and 4, and is brought to the open position shown in FIG. 6. When the screw 26 fastening the holder member 30 is loosened, the screw 26 and the holder member 30 fall along the elongated hole 224 due to their own weights and are brought to the first position. Thus, the holder member 30 is brought to the first position, and the heating roller 40 is easily taken out from the recessed mounting portions 221, 221.

According to the illustrated embodiment as described above, the operation in which the heating roller 40 is attached to, or detached from, the upper housing 20 becomes smoothly carried ut by loosening the screw 26 so as to bring the holder member 30 to the first position. Accordingly, this makes it possible to decrease the occurrence of such troubles that the surfaces of the roller body 41 are scarred during the attaching/detaching operation. Furthermore, by tightening the screw 26 with the holder member 30 to be located at the second position, the bearing members 43 attached to the heating roller 34 are stably held at the fitted positions. Therefore, the bearing members 43 that are fastened do not cause play even after the passage of time. This makes it possible to prevent the heater 42 from breaking in the heating roller 40 being caused by the occurrence of play. After the bearing members 43, 43 of the heating roller 40 are fitted to the recessed mounting portions 221, 221, furthermore, if it is attempted to bring the upper housing 20 to the closed position without fastening the holder member 30 by the screw 26 at the second position, the engaging portion 305 is brought into engagement with the recessed engaging portion 125 and it is not allowed to turn the upper housing 20. This makes it possible to prevent the upper housing 20 from being forgotten to be fastened by the holder member 30 and, hence, to prevent the heating roller 40 from falling.

Next, described below is a pressing roller 50 mounted on the lower housing 10.

Figure 7:
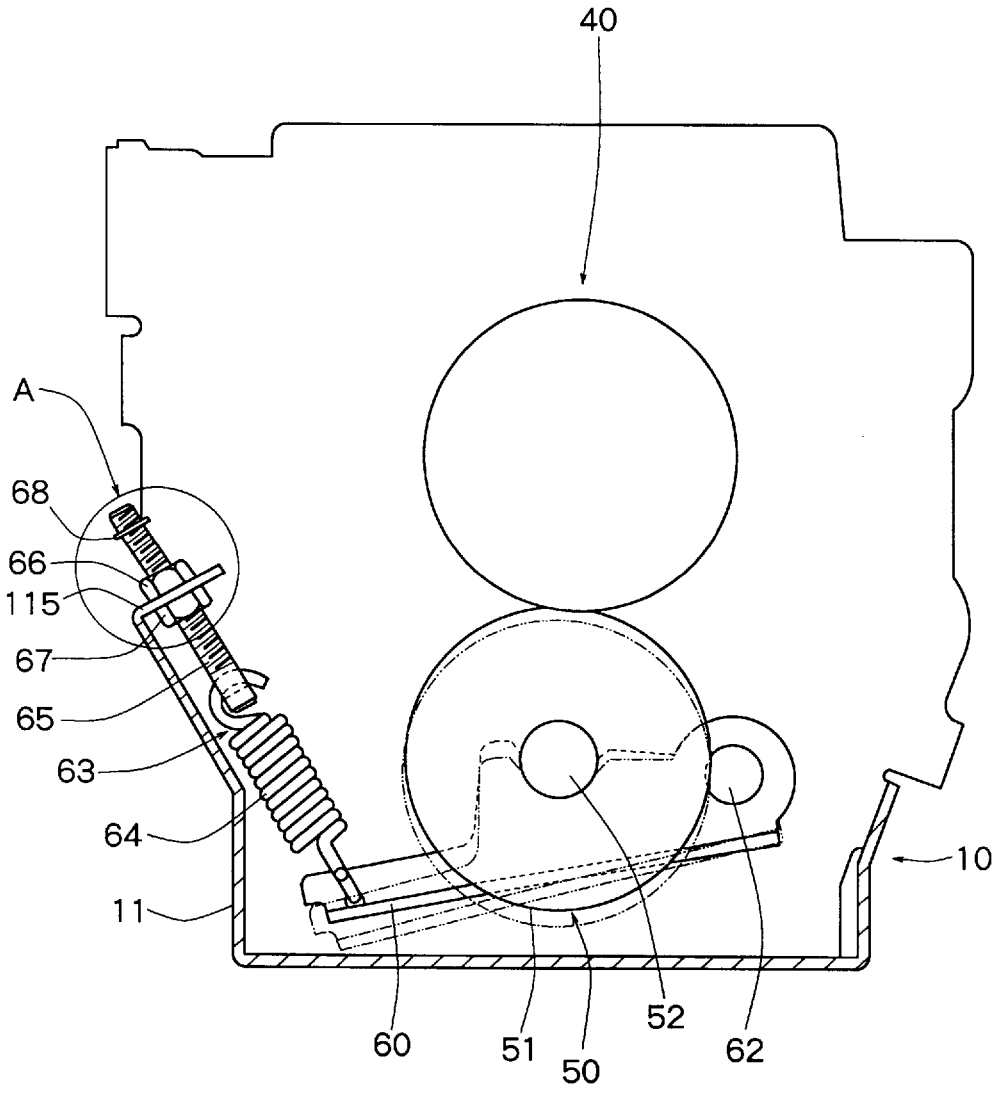
FIG. 7 is a side view illustrating a pushing mechanism for a pressing roller mounted on the lower housing of the fixing device shown in FIG. 1.

The pressing roller 50 comprises a roller body 51 constituted by fitting a cylindrical elastic roller portion made of a silicone rubber or the like onto a roller body of an aluminum alloy, and a support shaft 52 disposed at the center of the roller body 51. The pressing roller 50 is rotatably supported by roller support members 60, 60 arranged on the inside of the side plates 12, 12 that constitute the lower housing 10. The roller support members 60, 60 have recessed bearing portions 601, 601 at their central portions. Both ends of the support shaft 52 of the pressing roller 50 are rotatably supported by the recessed bearing portions 601, 601. One end of the roller support member 60 is rotatably supported by the side plate 12 of the lower housing 10 on a pivot 62, and the other end thereof is engaged with an end of a coil spring 64 that constitutes a pressing roller-pushing mechanism 63 as shown in FIGS. 1 and 7. The other end of the coil spring 64 is engaged with an engaging hole 651 formed at the lower end of an adjusting screw shaft 65 which is inserted in a hole (not shown) formed in the support portion 115 arranged on the upper end of the lower case plate 11 of the lower housing 10. Adjusting nuts 66 and 67 are fitted to the adjusting screw shaft 65 inserted in the hole formed in the support portion 115 on the upper side and on the lower side of the support portion 115, and by adjusting the positions of the adjusting nuts 66, 67, the adjusting screw shaft 65 can be secured at any position. By adjusting the position of the adjusting screw shaft 65 as described above, the tension of the coil spring 64 is adjusted, and the pressing force (fixing pressure) of the pressing roller 50 upon the heating roller 40 is adjusted.

Figure 8:
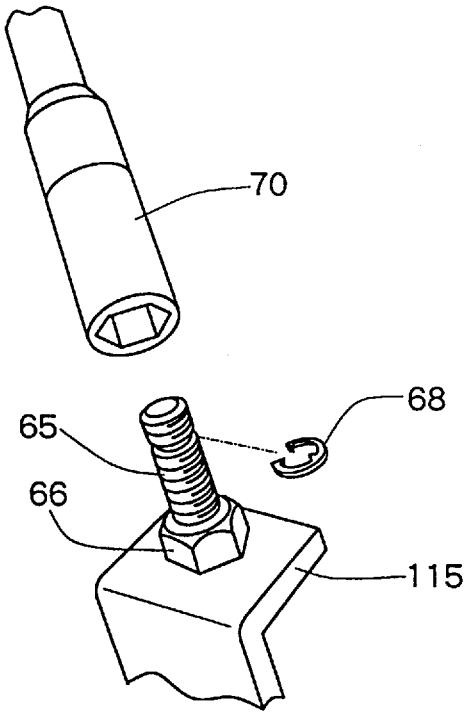
FIG. 8 is a perspective view illustrating, on an enlarged scale, a portion A of the pressing roller-pushing mechanism shown in FIG. 7.
Figure 9:
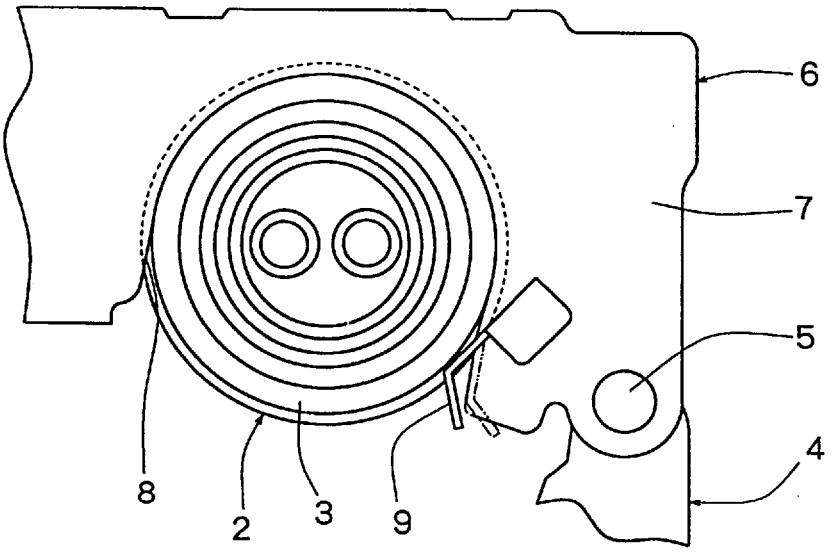
Fig. 9 PRIOR ART
FIG. 9 is a side view illustrating major portions of a conventional fixing device equipped with a structure for mounting the heating roller.

An E-ring 68 for preventing the escape is fitted to the upper end of the adjusting screw shaft 65. In the illustrated embodiment, the E-ring 68 has an outer diameter smaller than the outer diameter of the adjusting nut 66 of the upper side. For example, when the adjusting nut 66 has an M-size (distance between opposite sides: 7 mm), the E-ring 68 of E2.5 (outer diameter d: 6 mm) is used. Therefore, in adjusting the fixing pressure, the adjusting nut 66 can be turned by using a hexagonal driver 70 as shown in FIG. 8 without removing the E-ring 68, making it easy to adjust the fixing pressure. Furthermore, since the fixing pressure is adjusted without the need of removing the E-ring 68, the E-ring 68 is not lost. So far, a pin or a retaining ring has been used for preventing the escaping, and at the time of adjusting the fixing pressure, the pin or the retaining ring has been required to be removed before using the hexagonal driver, requiring cumbersome operation for adjustment. However, the illustrated embodiment solves these problems.

In the illustrated embodiment as shown in FIG. 1, furthermore, the upper cover plate 21 constituting the upper housing 20 is provided, at an upper portion thereof, with a cleaning blade 71 for removing the toner adhered to the peripheral surfaces of the heating roller 40 and is provided, at a lower portion thereof, with a transfer paper separator blade 72 for preventing a transfer paper that has passed through between the heating roller 40 and the pressure roller 50 from being wrapped round the heating roller 40. A cover 73 made of a synthetic resin is fastened to the upper surface of the upper case plate 21 by fastening means such as screws.

What I claim is:

1. A fixing device in an image-forming machine comprising a lower housing, an upper housing which is supported on one side of said lower housing and is allowed to rotate between a closed position and an open position, a pressing roller rotatably mounted on said lower housing, and a heating roller which has bearing members attached to both ends thereof and is detachably mounted on said upper housing, said upper housing being provided with nearly semicircular recessed mounting portions of which the lower portions are opened so that said bearing members attached to said heating rollers can be fitted thereto, and said heating roller being allowed to be attached to, or detached from, said recessed mounting portions in a state where said upper housing is located at the open position, wherein said upper housing is equipped with a holder member which is so constituted as to move to a first position where said bearing members attached to said heating roller are allowed to be attached to, or detached from, said mounting recessed portions, and to a second position where said it comes into contact with said bearing members fitted to said recessed mounting portions to maintain the fitting of said bearing members to said recessed mounting portions, and a fastening means is provided to fasten said holding member at said second position.

2. A fixing device in an image-forming machine according to claim 1, wherein said lower housing is provided with an engaging portion which will engage part of the holder member when said holder member is brought to said first position in a state where said upper housing is brought to the open position, and the upper housing is restricted from turning to the closed position from the open position in a state where said holder member is brought to said first position.

* * * * *